US007084722B2

(12) United States Patent
Goyette

(10) Patent No.: US 7,084,722 B2
(45) Date of Patent: Aug. 1, 2006

(54) SWITCHED FILTERBANK AND METHOD OF MAKING THE SAME

(75) Inventor: William R. Goyette, San Marcos, CA (US)

(73) Assignee: Northrop Grumman Corp., Los Angeles, CA (US)

( * ) Notice: Subject to any disclaimer, the term of this patent is extended or adjusted under 35 U.S.C. 154(b) by 37 days.

(21) Appl. No.: 10/896,720

(22) Filed: Jul. 22, 2004

(65) Prior Publication Data

US 2006/0017525 A1 Jan. 26, 2006

(51) Int. Cl.
*H01P 1/20* (2006.01)

(52) U.S. Cl. ..... 333/204; 333/205; 333/247

(58) Field of Classification Search ..... 333/203–205, 333/246, 247, 174, 175
See application file for complete search history.

(56) References Cited

U.S. PATENT DOCUMENTS

| | | | | |
|---|---|---|---|---|
| 4,763,089 | A | 8/1988 | Pon et al. | |
| 5,015,971 | A | 5/1991 | Taylor et al. | |
| 5,382,931 | A | 1/1995 | Piloto et al. | |
| 5,513,382 | A | 4/1996 | Agahi-Keshe et al. | |
| 5,867,535 | A | 2/1999 | Phillips et al. | |
| 5,923,232 | A * | 7/1999 | Europa et al. | 333/204 |
| 6,072,994 | A | 6/2000 | Phillips et al. | |
| 6,094,588 | A | 7/2000 | Adam | |
| 6,377,141 | B1 * | 4/2002 | Hirabayashi | 333/204 |
| 6,414,570 | B1 | 7/2002 | Dalconzo et al. | |
| 6,483,404 | B1 * | 11/2002 | Ammar et al. | 333/204 |
| 6,528,732 | B1 * | 3/2003 | Okubora et al. | 174/255 |
| 2002/0090974 | A1 * | 7/2002 | Hagn | 455/552 |
| 2004/0036558 | A1 | 2/2004 | Allison et al. | |
| 2005/0224845 | A1 * | 10/2005 | Tayrani | 257/275 |

OTHER PUBLICATIONS

George L. Matthaei, *Narrow-Band, Fixed-Tuned and Tunable Band-Pass Filters with Zig-Zag Hairpin-Comb Resonators*, Superconductor Technologies Inc., Santa Barbara, CA 93111, pp. 1-10, 2003.

* cited by examiner

*Primary Examiner*—Seungsook Ham
(74) *Attorney, Agent, or Firm*—Tarolli, Sundheim, Covell & Tummino LLP

(57) ABSTRACT

An integrated switched filterbank and method of forming an integrated switched filterbank is disclosed. One embodiment includes a switched filterbank that includes an active subassembly, a plurality of active devices mounted to the active subassembly, and a stripline filter subassembly stacked below the active subassembly. The stripline filter subassembly includes a plurality of stripline filters of varying passbands embedded therein, wherein the plurality of stripline filters are coupled to active devices mounted on the active subassembly through a set of contacts extending from the stripline filters through the active subassembly to at least one of the plurality of active devices.

24 Claims, 7 Drawing Sheets

SWITCHED FILTERBANK AND METHOD OF MAKING THE SAME

TECHNICAL FIELD

The present invention relates generally to electronic devices, and more particularly to a switched filterbank and method of making the same.

BACKGROUND OF THE INVENTION

Switched filterbanks are typically used in transceivers for pre-selection or post-selection of signals or channels. Filterbanks are typically constructed with a bank of discrete filters with a switch matrix to select the filter of choice. Filters are typically sub-octave and used to enhance receiver (RX) selectivity by rejecting unwanted signals at image frequencies and other points of spurious sensitivity. On the transmitter (TX) side, filters are used to reject unwanted spurious and harmonics prior to final amplification through a power amp stage. Physical implementation of switched filterbanks typically involve a 1:N switchbank, a bank of N discrete filters, and a N:1 switchbank. A typical planar implementation has significant area allocated to the switchbanks and filters. Much area is allocated to electrical isolation requirements and isolation grounding. The cost associated with discrete filters is substantially high. These filters are typically purchased as separate surface mount components, either as lumped element or ceramic resonator topologies.

Distributed filters designed on a radio frequency (RF) printed wiring board (PWB) employ a top microstrip layer that are typically quite large and very sensitive to cavity effects, necessitating isolation walls. Distributed stripline filters are difficult to build into standard RF PWB stackups without grossly driving up costs.

SUMMARY OF THE INVENTION

The present invention relates to an integrated switched filterbank and method of forming an integrated switched filterbank. One aspect of the present invention includes a switched filterbank that includes an active subassembly, a plurality of active devices mounted to the active subassembly, and a stripline filter subassembly stacked below the active subassembly. The stripline filter subassembly includes a plurality of stripline filters of varying passbands embedded therein, wherein the plurality of stripline filters are coupled to active devices mounted on the active subassembly through a set of contacts extending from the stripline filters through the active subassembly to at least one of the plurality of active devices.

Another aspect of the invention relates to a switched filterbank device. The switched filterbank device comprises an active subassembly having a top surface and a bottom surface, a plurality of switches mounted to the top surface, and a stripline filter assembly bonded to the bottom surface of the active subassembly. The stripline filter assembly includes a plurality of edge coupled comb-line stripline filters of varying lengths laid out in a side-by-side longitudinal arrangement and embedded in a dielectric. The plurality of stripline filters are coupled to the plurality of switches through contacts extending from opposed ends of the stripline filters through the active subassembly to the plurality of switches.

Yet another aspect of the invention relates to a method of fabricating a switched filterbank. The method comprises forming an active subassembly having a top surface and a bottom surface, fabricating a stripline filter subassembly having a plurality of stripline filters embedded in a dielectric layer, and bonding the stripline filter subassembly to the bottom surface of the active subassembly. Contacts are then formed through the top surface of the active subassembly to the plurality of stripline filters, and switches to the top surface of the active subassembly configured to provide filter paths for each of the plurality of stripline filters through the contacts.

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages and novel features of the invention will become apparent from the following detailed description of the invention when considered in conjunction with the drawings.

DETAILED DESCRIPTION OF INVENTION

The present invention relates to a switched filterbank and method of making the same. The switched filterbank is comprised of a multi-layer circuit assembly. The multi-layer circuit assembly can comprise a radio frequency (RF) printed wiring board (PWB) assembly, a low temperature co-fired ceramic (LTCC) structure, a semiconductor structure or other stacked circuit assembly. The multi-layer circuit assembly includes an active subassembly with a plurality of stripline filter devices fabricated in one or more stripline subassemblies stacked below the active subassembly. The stripline filter devices are laid out side-by-side in one or more stripline subassemblies stacked below the active subassembly to maximize density and preserve performance. The stripline filter devices are suited for higher frequency bandwidths, such as bandwidths operating in the L-band region (e.g., 400 MHZ to about 2.4 GHZ).

Figure 1:
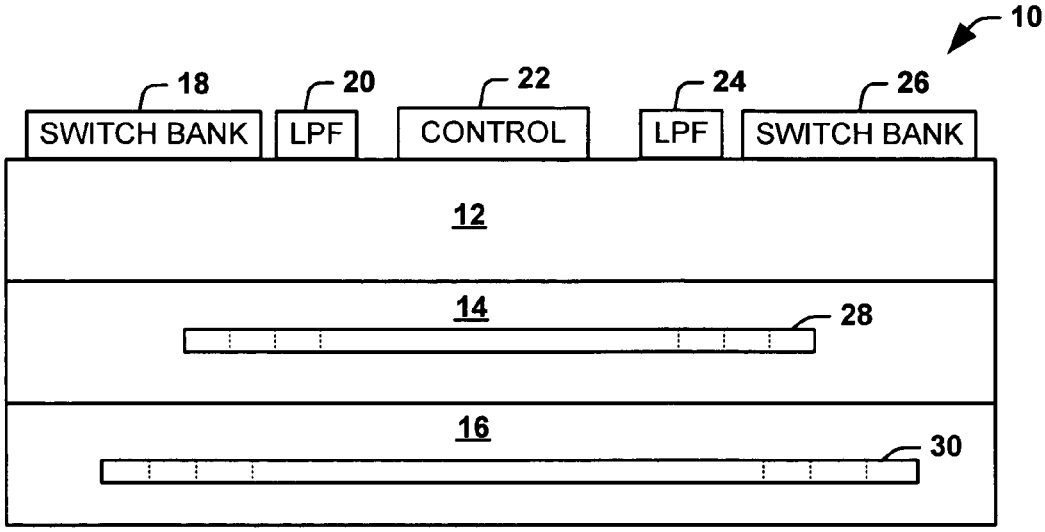
FIG. 1 illustrates a cross-sectional view of an integrated switched filterbank in accordance with an aspect of the present invention.

FIG. 1 illustrates an integrated switched filterbank 10 in accordance with an aspect of the present invention. The integrated switched filterbank 10 is programmable to select a filter from a plurality of filters to tune to a subband or channel of a wideband RF input signal. The integrated switched filterbank filters out frequencies outside of the selected subband or channel. The selected filter enhances receiver (RX) selectivity by rejecting unwanted signals at image frequencies and other points of spurious sensitivity about a selected subband or channel. The integrated switched filterbank employs a multi-layer circuit assembly with an active subassembly 12 and one or more stripline subassemblies 14, 16. The multi-layer circuit assembly can be a RF PWB assembly, a LTCC structure or other multi-layer structure. The active subassembly 12 is operative to provide a mounting surface to active devices associated with the integrated switched filterbank 10.

Each of the one or more stripline subassemblies includes a plurality of side-by-side stripline filter devices 28, 30. The stripline filter devices are fabricated by the combination of conductive material, surrounding dielectric and prepeg bonding material that comprise the stripline subassembly. The stripline filters are designed to be as space efficient as possible, with feeds at opposing ends of the respective filter. In one aspect of the invention, the stripline filters are comprised of edge coupled comb-line structures with an even number of resonators. This allows for a structure of length equal to a quarter wavelength of the center frequency, with feeds at opposite ends. Multiple filters of this topology can be laid out side-by-side in a space efficient manner, isolated by ground via pickets. The stripline dielectric material is constructed of RF PWB materials with a dielectric constant E greater than or equal to three (e.g., 3, 6, 10) and low loss characteristics and height controlled lamination prepregs for encapsulating the stripline conductive material. This provides for filters (e.g., in the L-Band regions) that are reasonable in size, use standard fabrication processes and can be mass-produced with excellent yield.

The number of stripline subassemblies depends on the number of desired stripline filters (e.g., 2, 4, 8, 16) in the integrated filterbank 10. The number of side-by-side stripline filter devices in a given stripline subassembly depend on the desired dimensions (e.g., width, length) of the switched filterbank device 10. For example, the integrated switched filterbank 10 includes two stripline subassemblies. Each stripline subassembly can have 2, 4 or 8 side-by-side stripline filters. In the present example, each stripline subassembly includes four stripline filters. Alternatively, the switched filterbank can have a single stripline subassembly with 2, 4 or 8 stripline filters. Furthermore, the switched filterbank can have 4 stripline subassemblies, each stripline subassembly having 2 or 4 side-by-side stripline filters.

In the integrated switched filterbank of FIG. 1, the active subassembly 12 is disposed above a first stripline subassembly 14 having one or more stripline filter devices 28 and a second stripline subassembly 16 having one or more stripline devices 30. The active subassembly 12 provides a mounting surface for active components associated with the integrated switched filterbank 10. The active components can include switchbanks, image rejection low pass filters, bias, power and control circuitry. The integrated switched filterbank 10 includes an input switchbank 18 and a first set of low band pass filters 20 disposed on a first region of the active subassembly 12. The input switchbank 18 is operative to receive a wideband RF input signal. The integrated switched filterbank 10 also includes a control device 22 disposed on a second region of the active subassembly. The control device 22 controls the selected frequency band or channel allowed to pass through the integrated filterbank 10. The control device 22 is programmable and selects the state of the switches associated with the integrated switched filterbank 10, and path through the selected stripline filter to provide the desired passband. The integrated switched filterbank 10 also includes an output switchbank 26 and a second set of low band pass filters 24 disposed on a third region of the active subassembly 12. The output switchbank 26 provides an RF output signal at the selected passband.

The active subassembly 12 includes a control layer (not shown) that includes conductive lines and contacts that couple the control device 22 to the switchbank and low band pass filter devices. Conductive lines and conductive contacts (not shown) from the active subassembly 12 couple the stripline filters 28 in the first stripline subassembly 14 and the stripline filters in the second stripline subassembly 16 to the switchbanks 18, 26 and low band pass filters 20, 24 mounted to the active subassembly 12. In one aspect of the invention, stripline subassemblies with stripline filters with shorter lengths (e.g., with higher frequency passbands) are disposed closer to the active subassembly than stripline subassemblies with stripline filters of longer lengths (e.g., with lower frequency passbands). This allows for simple via patterning (e.g., single via from active subassembly to a respective filter end) to couple ends of the stripline filters to the switches in the active subassembly 12, with out interfering with contacts between stacked stripline subassemblies 14 and 16. Therefore, conductive lines and conductive contact routing from the active subassembly 12 to the respective stripline subassembly can be simplified, thus simplifying fabrication of the integrated filterbank 10. The stripline filters are laid out in a side-by-side longitudinal arrangement to minimize the amount of area encompassed in both the first stripline subassembly 14 and the second stripline subassembly 16. By fabricating an integrated filterbank with control, switching and filtering circuitry mounted to an active subassembly with stripline filter devices fabricated in stripline subassemblies stacked below the active subassembly, a compact density maximized stacked integrated filterbank is provided, while preserving design performance and manufacturing repeatability.

In operation, the control circuitry 22 is programmed, for example, via input contact terminals to select a desired passband filter. The control circuitry 22 then closes a set of switches in the input switchbank 18 that routes an RF input signal through a respective low bandpass filter 20 to a selected passband stripline filter 28, 30 in one of the stripline subassemblies 14 and 16. The control circuitry 22 concurrently closes a set of switches in the output switchbank 26 that routes an RF output signal from the selected passband stripline filter 28, 30 through a respective low bandpass filter 24 as an RF output signal that can be provided to subsequent circuitry. The resultant output is a signal within a frequency range based on the selected passband stripline filter with unwanted spurious and harmonics responses removed, and unwanted signals at image (or comeback) frequencies removed (e.g., via the low bandpass filters).

Figure 2:
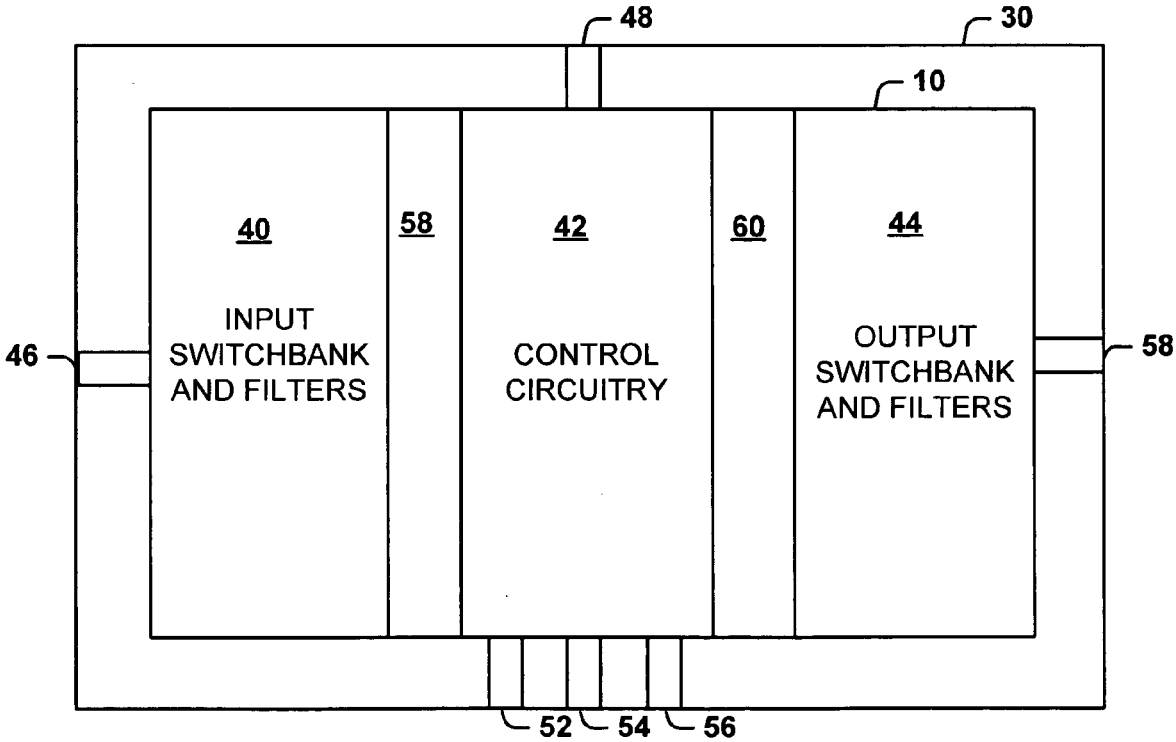
FIG. 2 illustrates a top plan view of the integrated switched filterbank of FIG. 1.

FIG. 2 illustrates a top plan view of the integrated switched filterbank 10 of FIG. 1. The integrated switched filterbank 10 is mounted on a larger PWB structure 30. The integrated switched filterbank 10 includes input switchbank and filters disposed in a first region 40, control circuitry disposed in a second region 42, and output switchbank and filters disposed in a third region 44. The first region 40 and second region 42 are separated by an isolation region 58, and the second region 42 and the third region 44 are separated by an isolation region 60. The integrated switched filterbank 10 can be mounted to the larger PWB structure 30 via a solder reflow technique.

The PWB structure 30 includes an input terminal 46 coupled to input switchbank and low band pass filter circuitry disposed in the first region 40. The input terminal 46 is operative to receive a RF input signal, and provide the RF input signal to the input switchbank and low band pass filter circuitry. The RF input signal can be provided by an antenna structure or amplifier coupled to an antenna structure if the integrated switched filterbank is employed as a receiver. In an application for a transmitter, the filterbank would by typically be inserted between the output of a modulator or exciter and a power amplifier. The filterbank could also be inserted between an output of a power amplifier and an antenna. The PWB structure 30 includes an output terminal 58 coupled to the output switchbank and low band pass filter circuitry disposed on the second region 44. The output terminal 58 is operative to provide an RF output signal corresponding to a selected subband or channel. The RF output signal 58 can be provided to demodulator or decoder circuitry for extracting the information signal from the selected subband or channel if the integrated switched filterbank is employed in a receiver. The RF output signal can be provided to either a power amplifier or antenna, which is fed by either a modulator (exciter) or a power amplifier if employed in a transmitter.

The PWB structure 30 includes a power supply terminal 48 that is coupled to the integrated switched filterbank structure 10. The power supply terminal 48 provides power to the control circuitry 42, switches and filters for performing functions associated with the integrated switched filterbank 10. Three control signal terminals 52, 54, 56 are provided for selecting a desired stripline filter, and thus a desired subband or channel. The three control signal terminals 52, 54, 56 allow for selection of one of eight subband filters for an eight channel filterbank employing a 3-to-8 decoder. The three control signal contact terminals 52, 54, 56 are coupled to the control circuitry in the second region 42. It is to be appreciated that a different number of control signals can be employed for a 4 channel, 16 channel, 32 channel, etc. filterbank. The layout of the switchbank, filters and control circuitry provides for easy scaling symmetrical binary feeds using single pole double throw (SPDT) switches in increments of powers of 2:2, 4, 8 and 16, centered input and feed of a plurality of filters in parallel, and easy coupling to routing of the final output to the edge of the structure.

The integrated filterbank is designed to provide a centered input and feed a plurality of filters in parallel. The integrated filterbank allows for easy scaling symmetrical binary feeds using SPDT switches in increments of powers of 2:2, 4, 8, and 16. A key feature is the routing of the final outputs to the edge of the structure. The active subassembly includes microstrip, ground, control and power layers. The materials are chosen to be as thin as possible. Low profile SMT components can be used on the top active subassembly. A harmonic and filter image (or comeback) rejection low-pass filter can be implemented with lumped SMT components for filter pairs to provide rejection of filter comebacks and overall high-end rejection.

Figure 3:
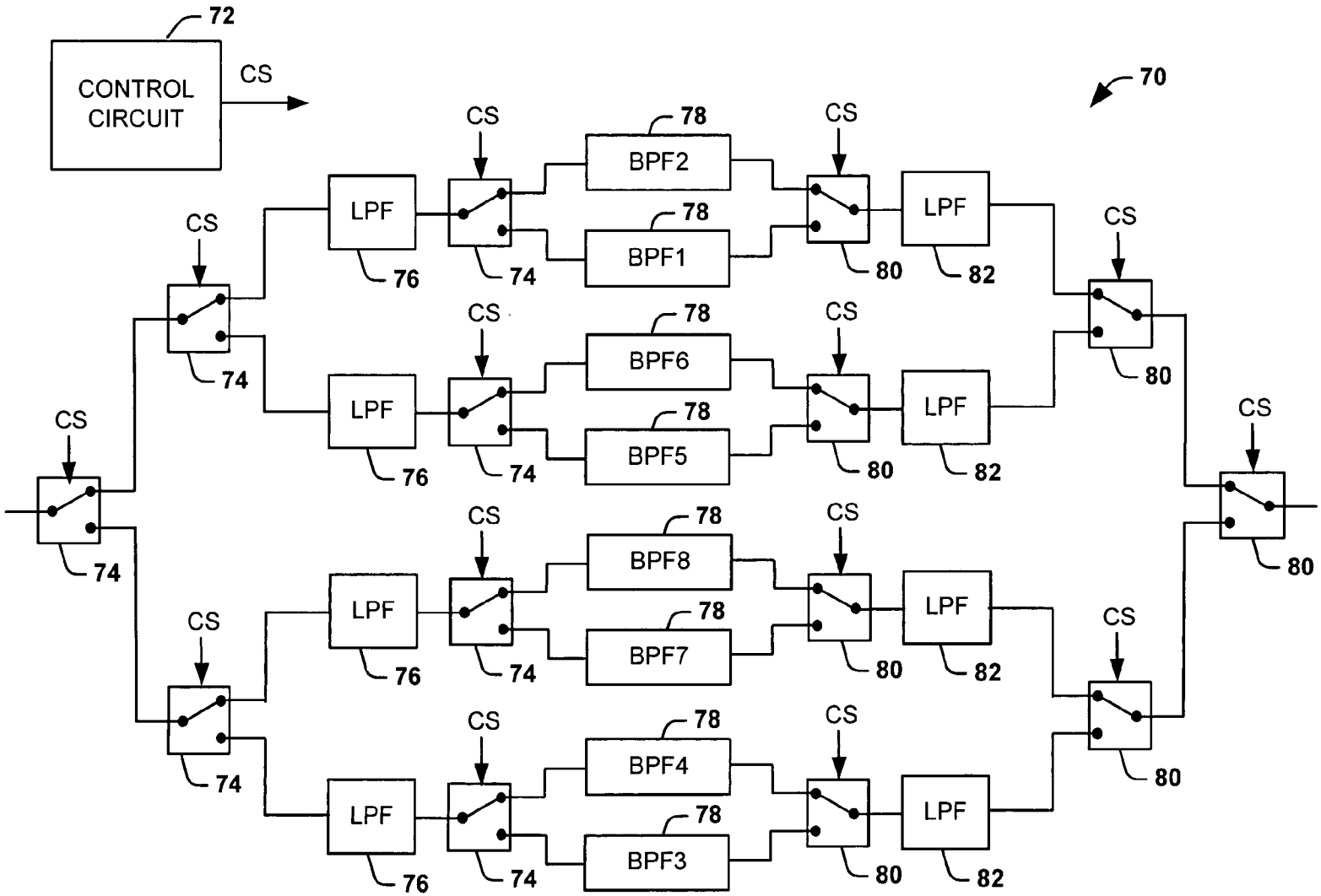
FIG. 3 illustrates a schematic block diagram of an eight channel integrated switched filterbank in accordance with an aspect of the present invention.

FIG. 3 illustrates a schematic diagram of an eight channel filterbank 70. The eight channel filterbank 70 includes an input section and an output section. The input section includes a plurality of single double throw switches (SPDT) 74 and a plurality of low band pass filters 76 arranged so that an RF input signal is routed to one of eight band pass filter devices 78 (BPF1–BPF8) through a low band pass filter based on the state of control signals (CS) generated by a control circuit 72. The output section includes a plurality of single double throw switches 80 and a plurality of low band pass filters 82 arranged so that an RF output signal is routed from one of eight band pass filter devices (BPF1–BPF8) through a low band pass filter to an output based on the state of control signals (CS) generated by the control circuit 72. In this manner, any one of the bandpass filters can be selected, and thus a portion of the input signal corresponding to the selected subband can be provided as output from the eight channel filterbank 70. The eight band pass filters can be a plurality of stripline bandpass filters fabricated in stripline subassemblies stacked (e.g, four filters per stripline subassembly) below the control circuitry, the low pass filters and the SPDT switches as illustrated in FIGS. 1 and 2. This provides for a maximum density compact design.

Figure 4:
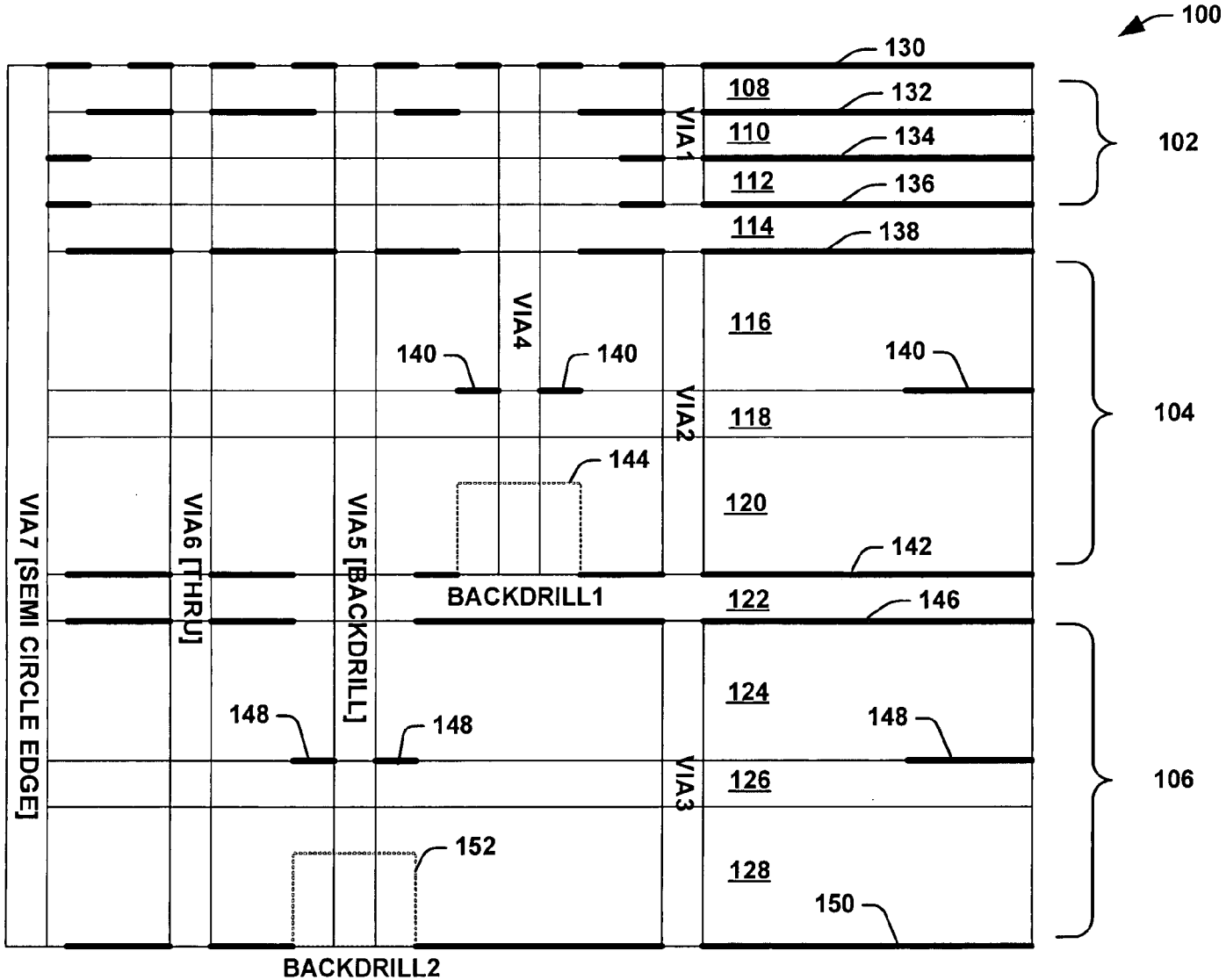
FIG. 4 illustrates a detailed illustration of a cross-section of a stacked layer integrated switched filterbank in accordance with an aspect of the present invention.

FIG. 4 illustrates a cross section of an integrated filterbank 100 in accordance with an aspect of the present invention. The integrated filterbank 100 is formed as a RF PWB assembly and includes an active subassembly 102, a first stripline subassembly 104 and a second stripline subassembly 106. It is to be appreciated that other stack structure types (e.g., LTCC, semiconductor structures, or other stacked structures) can be employed to fabricate the integrated filterbank 100. The active subassembly 102 includes a first portion comprised of a top microstrip layer 130 disposed above a first dielectric layer 108 where the first dielectric layer 108 is disposed above a first ground layer 132. The first dielectric layer 108 can have a thickness of about 10 thousands of an inch (mils). The active subassembly 102 also includes a second portion comprised of a control layer 134 disposed above a second dielectric 112 where the second dielectric is disposed above a power layer 136. The second dielectric layer 112 can have a thickness of about 10 mils. The first and second portions are bonded together with a prepeg material layer 110 (e.g., with a thickness of about 1.5 mils). A plurality of vias, labeled VIA1, are formed in the active subassembly 102, for example, by drilling a via pattern in the active subassembly 102. The plurality of vias, labeled VIA1, include control vias, power vias, and ground vias to couple the switchbanks, low pass filters and control circuitry together.

The first stripline subassembly 104 includes a plurality of first stripline filters 140 printed on a first side of a third dielectric layer 116 with a ground layer disposed on a second side of the third dielectric layer 116. The third dielectric layer 116 can have a thickness of about 25 mils. A fourth dielectric layer 120 includes a ground layer 142 coupled to a first side. The fourth dielectric layer 120 can have a thickness of about 25 mils. The fourth dielectric layer 120 is bonded on a second side to the first side of the third dielectric layer 116 via a prepeg material layer 118. The prepeg material layer 118 can be a composite consisting of a micro-porous polytetrafluorethylene (PTFE) structure impregnated with a thermosetting adhesive, for example, SPEEDBOARD® manufactured by W.L. Gore and Associates, Inc. The prepeg material layer 118 can have a thickness of about 1.5 mils. A plurality of vias, labeled VIA2, are formed in the first stripline subassembly 104 to connect the ground layers to the first stripline subassembly 104, for example, by drilling a via pattern in the first stripline subassembly 104. The third dielectric layer can have a thickness of about 25 mils.

The first stripline subassembly 104 is then bonded to the active subassembly 102 via a prepeg material layer 114. The prepeg material layer 114 can have a thickness of about 3.0 mils. A plurality of filter connecting vias, labeled VIA4, are then patterned through the active subassembly 102 and the first stripline subassembly 104 for connecting the active devices to the stripline filters in the first stripline subassembly 104. A back drill recess 144 is then formed on the plurality of connecting vias, labeled VIA4, to provide for fifty ohm impedance matching between the plurality of first stripline filters 140 and the switching circuitry.

The second stripline subassembly 106 includes a plurality of second stripline filters 148 printed on a first side of a fifth dielectric layer 124 with a ground layer 146 disposed on a second side of the fifth dielectric layer 124. The fifth dielectric layer 124 can have a thickness of about 25 mils. A sixth dielectric layer 128 includes a ground layer 150 coupled to a first side. The sixth dielectric layer 128 can have a thickness of about 25 mils. The sixth dielectric layer 128 is bonded on a second side to the first side of the fifth dielectric via a prepeg material layer 126. The prepeg material layer 126 can have a thickness of about 1.5 mils. The prepeg material 126 can be a composite consisting of a micro-porous polytetrafluorethylene (PTFE) structure impregnated with a thermosetting adhesive, for example, SPEEDBOARD® manufactured by W.L. Gore and Associates, Inc. A plurality of vias, labeled VIA3, are formed in the second stripline subassembly 106 to connect the ground layers to the second stripline subassembly 106, for example, by drilling a via pattern in the second stripline subassembly 106. The second stripline subassembly 106 is then bonded to the first stripline subassembly 104 via a prepeg material layer 122. The prepeg material layer 122 can have a thickness of about 1.5 mils. The prepeg material layer 122 can be a composite consisting of a micro-porous polytetrafluorethylene (PTFE) structure impregnated with a thermosetting adhesive, for example, SPEEDBOARD® manufactured by W.L. Gore and Associates, Inc.

The third, fourth, fifth and sixth dielectric layers 116, 120,124,128 can be formed from a dielectric material with a substantially high dielectric constant (e.g., E≧3.0, E≧6.0, E≧10.0). For example, the dielectric material can be a high frequency circuit material such as a ceramic filled laminate with woven fiber glass, for example, R03203™, R03206™, RO3210™ manufactured by Rogers Corporation.

A plurality of filter connecting vias, labeled VIA5, are then patterned through the active subassembly 102, the first stripline subassembly 104 and the second stripline subassembly 106 for connecting the switches to the plurality of second stripline filters 148. A back drill recess 152 is then formed on the plurality of connecting vias, labeled VIA5, to provide for fifty ohm impedance matching between the plurality of second stripline filters 148 and the switching circuitry. The back drilling is used on fifty ohm transitions from the microstrip to the first and second stripline subassemblies to facilitate the maintenance of fifty ohm impedance matching. Additionally, a plurality of connecting vias, labeled VIA6, is patterned through the active subassembly 102, the first stripline subassembly 104 and the second stripline subassembly 106 for connecting the grounds planes together. Finally, a plurality of vias, labeled VIA7, is patterned through the active subassembly 102, the first stripline subassembly 104 and the second stripline subassembly 106 for providing external connections and electrical isolation.

The first stripline subassembly 104 and the second stripline subassembly 106 are formed of RF PWB materials with higher dielectric constants (e.g., E≧3.0), and low loss characteristics and high controlled lamination prepegs. This allows for filters (e.g., L-Band filters) that are reasonable in size, use standard fabrication process and can be mass produced with excellent yields. SMT components are mounted to the active subassembly. The whole assembly can then be solder re-flowed onto a larger PWB, with electrical connections for power, control and RF made at the connection between the bottom of the brick and the host PWB. For example, an eight channel filterbank can be fabricated that is 1.25"×2.25"×0.185" including SMT components. The actual thickness of the multi-layer PWB can be less than 0.15".

Three transitions were designed to provide controlled fifty ohm impedance path layers. The fifty ohm transitions include the size of the pads on the top and bottom assemblies, the size of the cutout in the ground layers, and the vias diameter including the extensions. The extensions are minimized by a back drilling process. The transition from the SMT launch to the top microstrip was effected through a semicircular coaxial transition. The two transitions from top microstrip to each stripline subassembly were designed as a coaxial transition with ground to be broadband controlled fifty ohm impedances. To minimize cost and allow for simple construction, the transitional via is back-drilled to minimize parasitic effects (as opposed to a blind via process).

Figure 5:
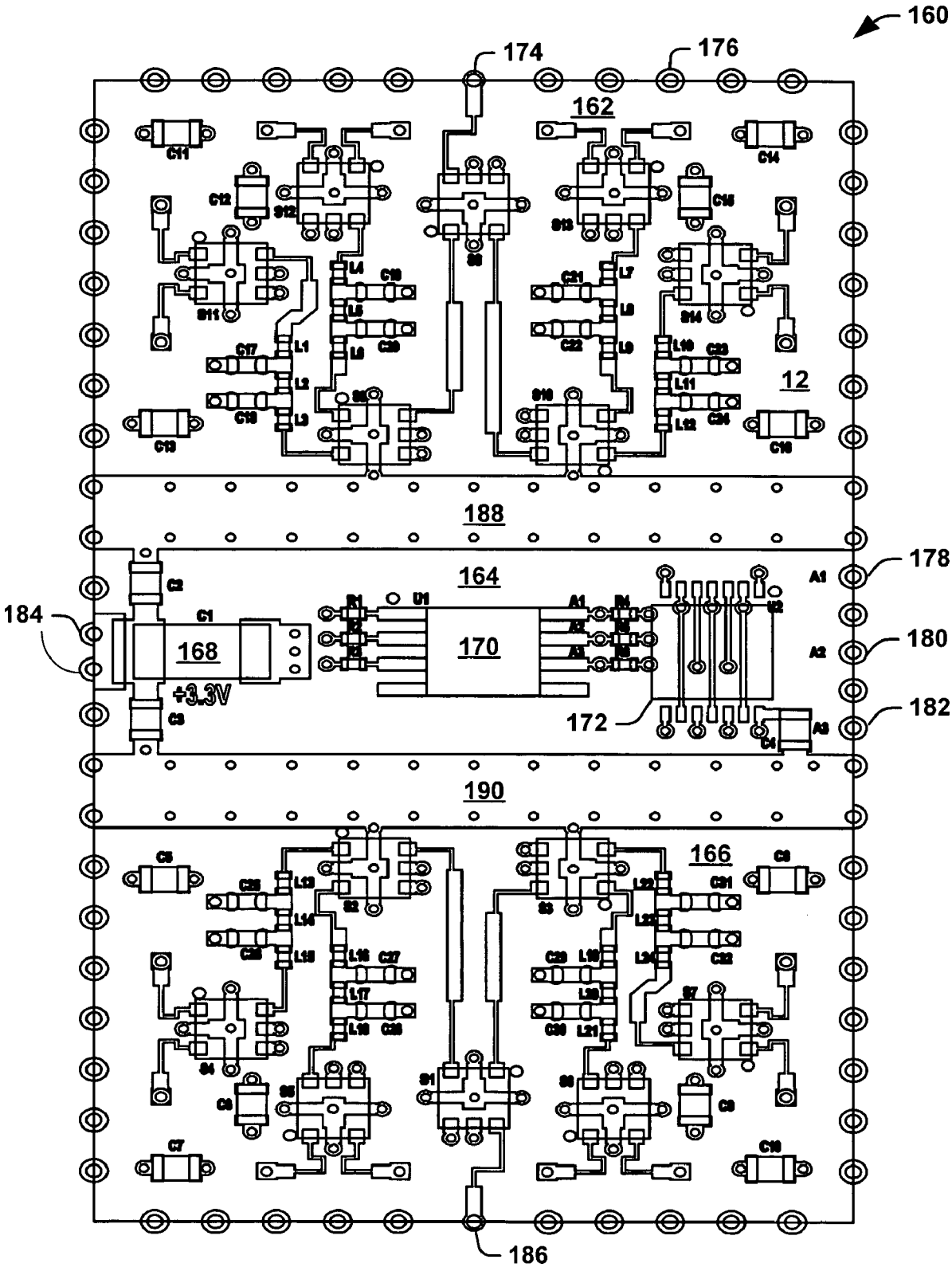
FIG. 5 illustrates a plan view of an active subassembly of a switched filterbank in accordance with another aspect of the present invention.

FIG. 5 illustrates a top schematic view of an active subassembly 160 of an eight channel integrated filterbank in accordance with an aspect of the present invention. The active subassembly 160 includes a first region 162 that includes a plurality of input switches, low band pass filters and associated bypass capacitor decoupling circuitry. The first region 162 is operative to receive a RF input signal through an input contact terminal 174 coupled to a first input switch. The plurality of input switches, and low band pass filters are schematically illustrated in FIG. 3. The active subassembly 160 includes a second region 166 that includes a plurality of output switches, low band pass filters and associated bypass capacitor decoupling circuitry. The second region 166 is operative to provide a RF output signal through an output contact terminal 186 coupled to a final output switch. The plurality of output switches, and low band pass filters are schematically illustrated in FIG. 3.

The active subassembly 160 includes a central region 164 which retains the control and power circuitry. The central region 164 is isolated from the first region 162 by a first isolation region 188, and the central region 164 is isolated from the second region 166 by a second isolation region 190. The control and power circuitry include a filter capacitor 168, an optional dip switch 170 for self test and a 3-to-8 inverter decoder 172. The 3-to-8 inverter decoder is programmed via three input control contact terminals 178, 180 and 182. The state of the input control terminals 178, 180 and 182 determine the path through the plurality of input switches, associated low band pass filters, selected passband filter (not shown), and the plurality of output switches and associated low band pass filters. The filter capacitor 168 is coupled to power supply terminals 184 for providing clean power to the active devices on the active subassembly 160. The outer perimeter of the active subassembly 160 and subsequent stripline filter subassemblies are surrounded by contacts 176 that provide shielding from electromagnetic fields in addition to providing input contact terminals to the active devices on the active subassembly 160.

Figure 6:
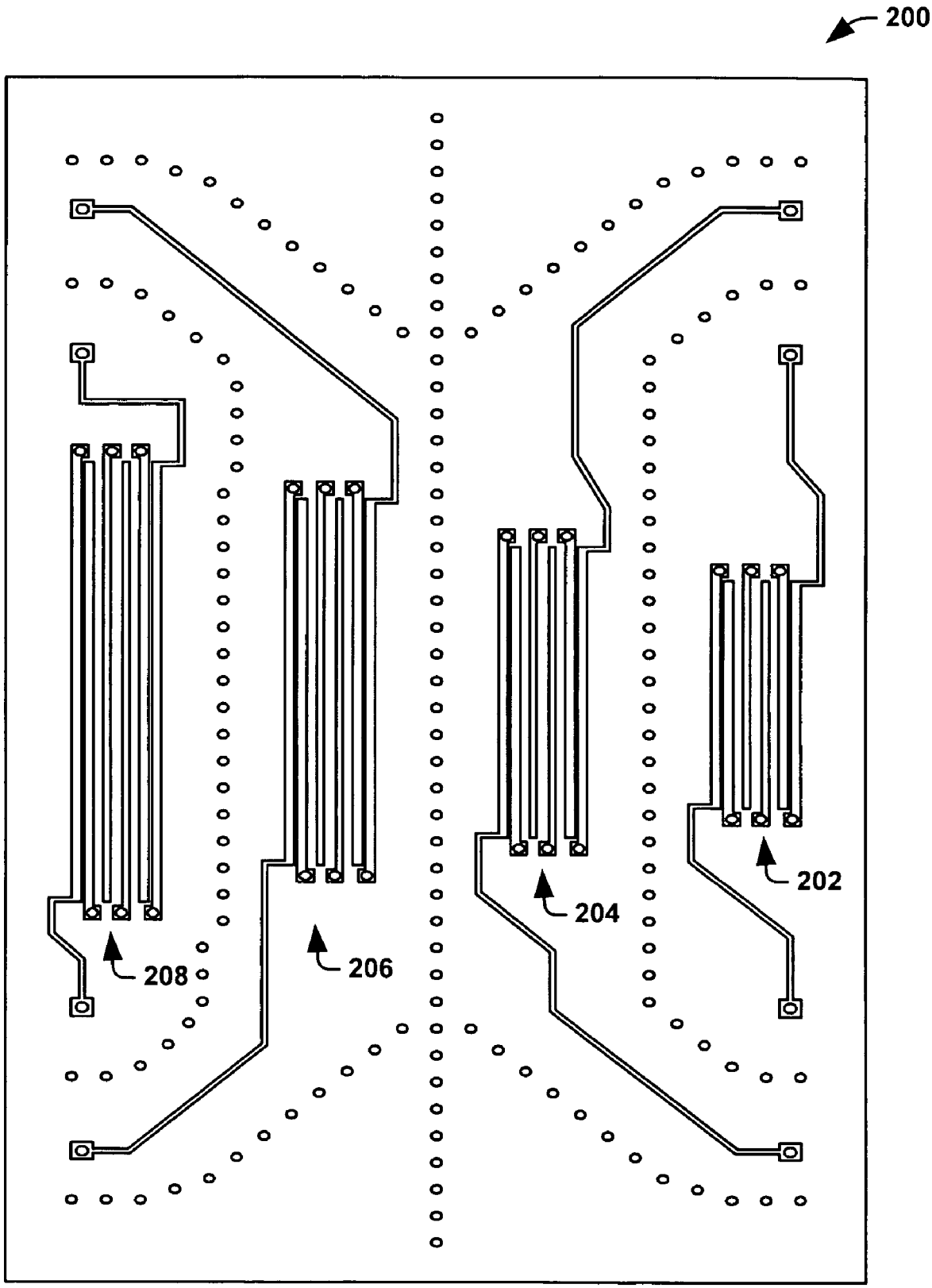
FIG. 6 illustrates a plan view of an intermediate stripline subassembly of a switched filterbank in accordance with another aspect of the present invention.

FIG. 6 illustrates a top plan view of an intermediate stripline filter subassembly 200 in accordance with an aspect of the present invention. The stripline filter subassembly 200 includes four stripline filters that are laid out side-by-side arrangement and extend in a longitudinal direction along the stripline filter subassembly 200. The stripline filters are comprised of edge coupled comb-line structures with an even number of resonators. This allows for a structure of length equal to a quarter wavelength of the center frequency, with feeds at opposite ends. Multiple filters of this topology are laid out side-by-side in a space efficient manner, isolated by ground via pickets. The stripline dielectric material is constructed of RF PWB materials with a dielectric constant E greater than or equal to three (e.g., 10) and low loss characteristics and height controlled lamination prepregs for encapsulating the stripline conductive material. This provides for filters (e.g., in the L-Band regions) that are reasonable in size, use standard fabrication processes and can be mass-produced with excellent yield.

The shorter the filter the higher the passband frequency of the respective filter. For example, a first filter 202 is provide for filtering out frequencies outside a first passband, a second filter 204 is provide for filtering out frequencies outside a second passband, a third filter 206 is provide for filtering out frequencies outside a third passband, and a fourth filter 208 is provide for filtering out frequencies outside a fourth passband. The first passband is at a frequency range that is higher than the second passband, third passband, and fourth passband. The second passband is at a frequency range that is higher than the third passband and the fourth passband, and the third passband is at a frequency range that is higher than the fourth passband.

Each stripline filter is comprises of a conductive material (e.g., copper) printed on a dielectric layer and embedded in a dielectric material layer bonded by a prepeg material layer, such that the material between the conductive material has a dielectric constant that is greater than or equal to three. Each stripline filter 202, 204, 206 and 208 includes contacts coupled at each end that are coupleable to the switching circuitry. The dielectrics and conductive material of the stripline filter subassembly 200 form a multi-stripline filter assembly that can be bonded to the active subassembly 160 to form an integrated switched filterbank assembly.

Figure 7:
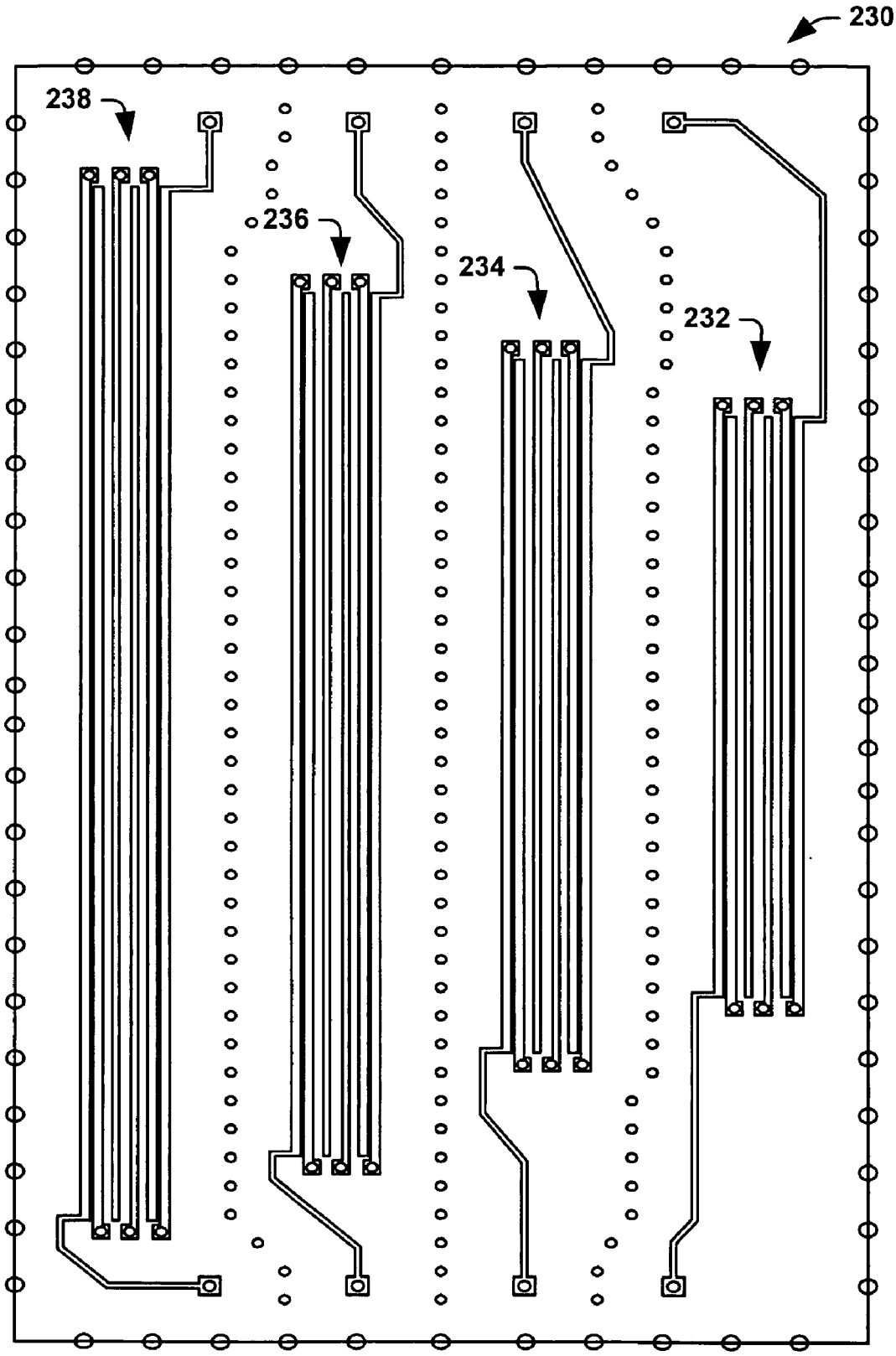
FIG. 7 illustrates a plan view of an outer stripline subassembly of a switched filterbank in accordance with another aspect of the present invention.

FIG. 7 illustrates a top plan view of an outer stripline filter subassembly 230 in accordance with an aspect of the present invention. The outer stripline filter subassembly 230 includes four stripline filters that are laid out side-by-side arrangement and extend in a longitudinal direction along the stripline filter subassembly 230. The stripline filters are comprised of edge coupled comb-line structures with an even number of resonators. This allows for a structure of length equal to a quarter wavelength of the center frequency, with feeds at opposite ends. Multiple filters of this topology are laid out side-by-side in a space efficient manner, isolated by ground via pickets. The stripline dielectric material is constructed of RF PWB materials with a dielectric constant E greater than or equal to three (e.g., 10) and low loss characteristics and height controlled lamination prepregs for encapsulating the stripline conductive material.

The shorter the filter the higher the passband frequency of the respective filter. For example, a fifth filter 232 is provided for filtering out frequencies outside a fifth passband, a sixth filter 234 is provide for filtering out frequencies outside a sixth passband, a seventh filter 236 is provide for filtering out frequencies outside a seventh passband, and an eight filter is provide for filtering out frequencies outside an eighth passband. The fifth passband is at a frequency range that is higher than the sixth, seventh, and eight passband. The second passband is at a frequency range that is higher than the seventh and the eight passband, and the seventh passband is at a frequency range that is higher than the eight passband.

The fifth, sixth, seventh and eighth passband are at frequency ranges that are lower than the frequency ranges of the first, second, third and fourth passband of the intermediate stripline filter subassembly 200 of FIG. 6, since the fifth, sixth, seventh and eight filters 232, 234, 236 and 238 are longer than the first, second, third and fourth filters 202, 204, 206 and 208. Each stripline filter is comprises of a conductive material (e.g., copper) printed on a dielectric layer and embedded in a dielectric material layer bonded by a prepeg material layer, such that the material between the conductive material has a dielectric constant that is greater than or equal to three. Each stripline filter 232, 234, 236 and 238 includes contacts coupled at each end that are coupleable to the switching circuitry. The dielectrics and conductive material of the stripline filter subassembly 230 form a multi-stripline filter assembly that can be bonded to the intermediate subassembly 200, which is bonded to the active subassembly 160 to form an eight channel integrated switched filterbank.

In one aspect of the invention, the stripline filters are selected to provide overlapping filters of approximately 30% band widths covering the L-Band region from 450 MHz to 2400 MHz. In another aspect of the present invention, stripline filters are selected with overlapping filters of approximately 17% band with filters with 16 overlapping filters covering the L-Band region.

Figure 8:
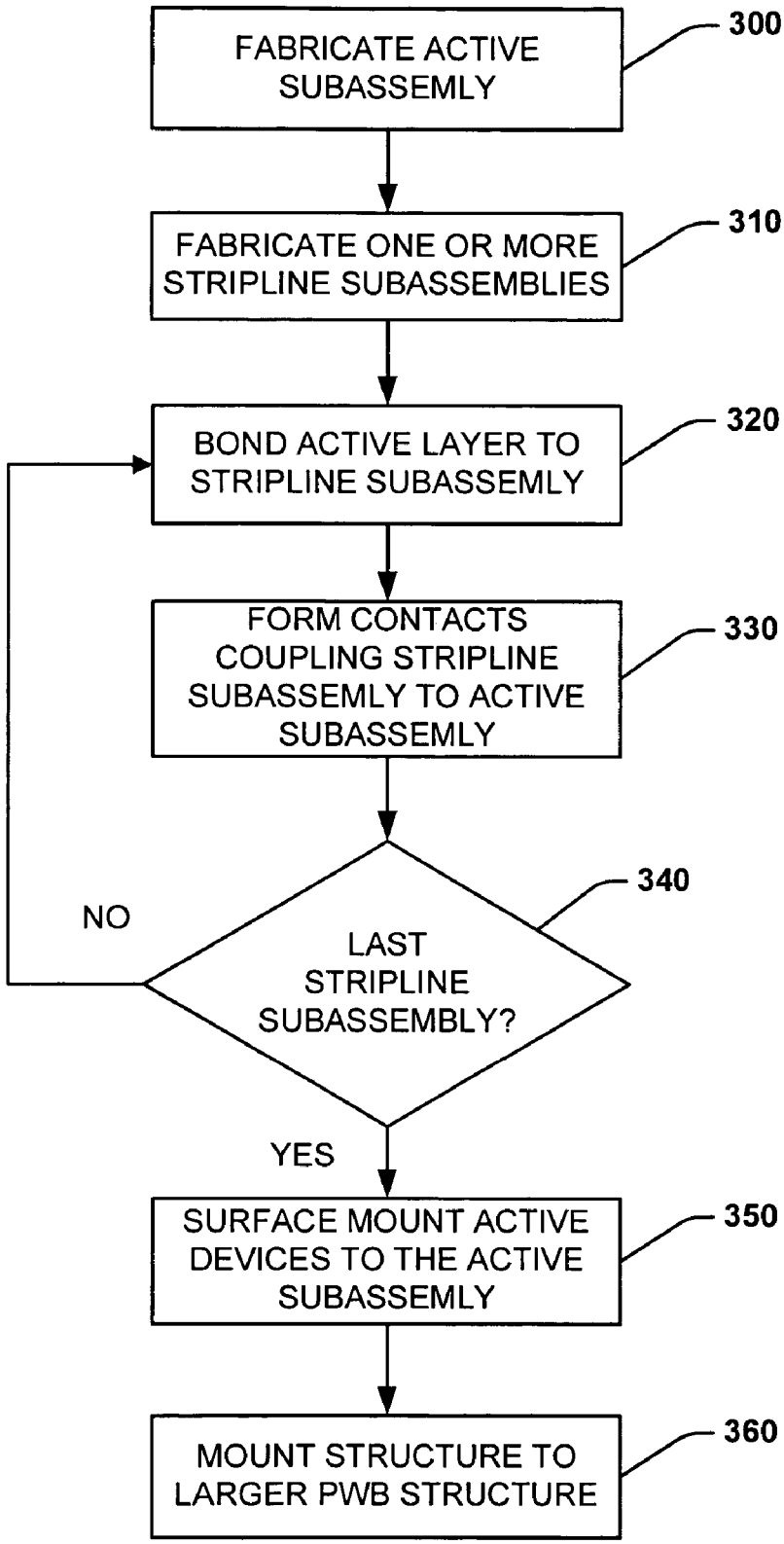
FIG. 8 illustrates a methodology for fabricating an integrated switched filterbank in accordance with an aspect of the present invention.

In view of the foregoing structural and functional features described above, methodologies in accordance with various aspects of the present invention will be better appreciated with reference to FIG. 8. While, for purposes of simplicity of explanation, the methodologies of FIG. 8 are shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention.

FIG. 8 illustrates a methodology for fabricating an integrated switch filterbank in accordance with an aspect of the present invention. At 300, an active subassembly is fabricated. Fabrication of the active subassembly can include fabricating a microstrip layer, a ground layer, a control layer and a power layer. The microstrip layer provides a mounting surface for the active devices, while the control layer provides the interconnections between the active devices. Fabrication of the active subassembly can also include patterning vias for providing ground and power interconnections between subsequent layers of the active subassembly. This can include lamination and via drill and plating to form contacts within the active subassembly. At 310, one or more stripline subassemblies are fabricated. A stripline subassembly can be fabricated by printing a plurality (e.g., 2, 4, 8) of stripline filters in a side-by-side longitudinal arrangement formed by a conductive material on an internal side of a first dielectric layer and bonding the internal side of the first dielectric layer to a second dielectric layer by a prepeg material layer, such that the material between the conductive material has a dielectric constant that is greater than or equal to three. Fabrication of the stripline filter subassembly can also include patterning vias for providing ground and power interconnections between subsequent layers of the stripline filter subassembly. This can include lamination and via drill and plating to form contacts within the stripline filter subassembly.

Additionally, one or more stripline subassemblies can be formed. The one or more additional stripline subassemblies can include a plurality of additional printed stripline filters (e.g., 2, 4, 8) in a side-by-side longitudinal arrangement disposed between two dielectric layers. The stripline filters can be arranged with different frequency sets in each corresponding stripline subassembly, such that higher frequency (shorter length) filters are provided in one or more intermediate subassemblies with lower frequency (longer length) filters provided at the outer subassemblies to facilitate interconnections between the filters and the active subassembly. The methodology then proceeds to 320.

At 320, the active subassembly is bonded to a stripline filter subassembly to form a multi-layer circuit assembly. It is to be appreciated that the multi-layer assembly can be a RF PWB assembly, a LTCC structure or other stacked layer device. At 330, contacts between the active subassembly to the filters of the stripline are formed. The contacts connect the switch devices on the active subassembly to the filters on the stripline subassemblies. The contacts can be formed by forming via patterns through the active subassembly and the one or more stripline subassemblies. The via patterns can then be filled with a contact material and planarized. The ends of the contacts can be back drilled to remove excess contact material, and provide for fifty ohm impedance matching. The methodology then proceeds to 340.

At 340, the methodology determines if a last stripline filter subassembly has been bonded to the multi-layer circuit assembly. If the last stripline filter subassembly has not been bonded to the multi-layer circuit assembly (NO), the methodology returns to 320 to bond the next stripline filter subassembly to the multi-layer circuit assembly, and then form contacts between the next stripline filter subassembly and the active subassembly. If the last stripline filter subassembly has been bonded to the multi-layer circuit assembly (YES), the methodology proceeds to 350.

At 350, the active devices are surface mounted to the active subassembly. The active devices include the switches associated with the switchbank, the low band pass filters, and the control and power circuitry associated with controlling the switches and providing power to the active devices. The active devices can be soldered to the active subassembly via a solder reflow techniques or the like. At 360, the integrated filterbank is mounted to a larger PWB structure. The larger PWB structure can include input contact terminals for the RF input, control signal, power supply and RF output contact terminals. The integrated filterbank can be mounted to the larger PWB structure by a solder reflow technique.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. An integrated switched filterbank comprising:

an active subassembly;

a plurality of active devices mounted to the active subassembly:

a stripline filter subassembly stacked below the active subassembly, the stripline filter subassembly having a plurality of stripline filters of varying passbands embedded therein, wherein the plurality of stripline filters are coupled to active devices mounted on the active subassembly through a set of contacts extending from the stripline filters through the active subassembly to at least one of the plurality of active devices; and a second stripline filter subassembly of stripline filters of varying passbands mounted beneath the stripline filter subassembly, the stripline filters of the second stripline filter subassembly being coupled to active devices mounted on the active subassembly through a set of contacts extending from the stripline filters of the second stripline filter subassembly through the stripline filter subassembly and the active subassembly to the at least one of the plurality of active devices.

2. The switched filterbank of claim 1, the plurality of active devices comprising an input switchbank and low pass filter set disposed on a first region of the active subassembly, an output switchbank and low pass filter set disposed on a second region, and control circuitry disposed in a third region.

3. The switched filterbank of claim 2, the first region being located on a first end of the active subassembly, the second region being located on a second end of the active subassembly and the third region being located between the first region and second region wherein isolation regions separate the third region from the first region and the second region.

4. The switched filterbank of claim 1, the plurality of stripline filters comprising a plurality of edge coupled comb-line structures laid out in a side-by-side longitudinal arrangement.

5. The switched filterbank of claim 4, the plurality of edge coupled comb-line structures having an even number of resonators with interconnections at opposing ends.

6. The switched filterbank of claim 1, the stripline filter subassembly comprised of conductive material being encapsulated by dielectric material layers and prepeg material that provide the stripline filters with a dielectric having a dielectric constant greater than or equal to three.

7. The switched filterbank of claim 1, the stripline filters of the second stripline filter subassembly having a length that is longer than the length of the stripline filter in the stripline filter subassembly to facilitate interconnections between the active subassembly and the stripline filters in both the stripline filter subassembly and the second stripline filter subassembly.

8. The switched filterbank of claim 1, further comprising a plurality of contacts extending around an output perimeter of the switched filterbank for providing input contacts and shielding from electromagnetic fields.

9. A switched filterbank device comprising:

an active subassembly having a top surface and a bottom surface;

an input switchbank disposed on a first region of the top surface of the active subassembly, and an output switchbank disposed on a second region of the top surface of the active subassembly, and control circuitry disposed on a third region of the top surface of the active subassembly, the third region being between the first region and the second region; and a stripline filter subassembly bonded to the bottom surface of the active subassembly, the stripline filter subassembly having a plurality of edge coupled comb-line stripline filters of varying lengths laid out in a side-by-side longitudinal arrangement and embedded in a dielectric, wherein the plurality of stripline filters have opposing ends that are coupled to the input switchbank and the output switchbank, respectively, through contacts extending from opposed ends of the stripline filters through the active subassembly to the top surface of the active assembly.

10. The switched filterbank of claim 9, further comprising a first low pass filter set disposed on the first region and a second low pass filter set disposed on the second region.

11. The switched filterbank of claim 9, the edge coupled comb-line stripline filters having an even number of resonators with interconnections at opposing ends.

12. The switched filterbank of claim 9, the dielectric comprising a first dielectric layer, a second dielectric layer and a prepeg material layer disposed between the first dielectric layer and the second dielectric layer, the prepeg material layer comprising a prepeg material formed of a micro-porous polytetrafluorethylene structure impregnated with a thermosetting adhesive, and the first dielectric layer and the second dielectric layer comprising a ceramic filled laminate with woven fiber glass with a dielectric constant greater than or equal to three.

13. The switched filterbank of claim 9, further comprising a second stripline filter subassembly bonded to a bottom surface of stripline filter subassembly, the second stripline filter subassembly having a plurality of edge coupled comb-line stripline filters of varying lengths laid out in a side-by-side longitudinal arrangement and embedded in a dielectric having a dielectric constant greater than or equal to three, wherein the plurality of stripline filters of the second stripline filter subassembly are coupled to the plurality of switches through contacts extending from opposed ends of the stripline filters through the stripline filter subassembly and the active subassembly to the plurality of switches.

14. The switched filterbank of claim 13, being an eight channel filterbank with four filters in the stripline filter subassembly and four filters in the second stripline filter subassembly.

15. The switched filterbank of claim 14, the stripline filters of the second filter subassembly have a length that is longer than the length of the stripline filters in the stripline filter subassembly to facilitate interconnections between the plurality of switches and the stripline filters.

16. The switched filterbank of claim 14, the filters in the eight channel filterbank providing passbands across the L-Band region.

17. A method of fabricating a switched filterbank, the method comprising:

forming an active subassembly having a top surface and a bottom surface;

fabricating a stripline filter subassembly comprising:

printing a conductive material on a first dielectric layer in the form of a plurality of edge coupled comb-line stripline filters of varying lengths laid out in a side-by-side longitudinal arrangement;

bonding the first dielectric layer to a second dielectric layer using a prepeg material formed of a micro-porous polytetrafluorethylene structure impregnated with a thermosetting adhesive; and wherein the first dielectric layer and the second dielectric layer are formed of a ceramic filled laminate with woven fiber glass with a dielectric constant greater than or equal to three;

bonding the stripline filter subassembly to the bottom surface of the active subassembly;

forming contacts between the top surface of the active subassembly and the plurality of stripline filters; and mounting switches to the top surface of the active subassembly configured to provide filter paths for each of the plurality of stripline filters through the contacts.

18. The method of claim 17, further comprising mounting control circuitry on the top surface of the active subassembly, such that an input switchbank is disposed on a first end of the active subassembly, and an output switchbank is disposed on a second end of the active subassembly, and control circuitry is disposed between the input switchbank and the output switchbank.

19. The method of claim 18, the forming an active subassembly having a top surface and a bottom surface further comprising forming a control layer that couples the control circuitry to the input switchbank and the output switchbank.

20. The method of claim 17, further comprising:

forming a second stripline filter subassembly having a plurality of edge coupled comb-line stripline filters of varying lengths laid out in a side-by-side longitudinal arrangement and embedded in a dielectric having a dielectric constant greater than or equal to three;

bonding the second stripline filter subassembly to a bottom surface of the stripline filter subassembly, the second stripline filter subassembly having a plurality of second edge coupled comb-line stripline filters of varying lengths laid out in a side-by-side longitudinal arrangement embedded in a dielectric having a dielectric constant greater than or equal to three; and forming contacts through the top surface of the active subassembly to the plurality of second edge coupled comb-line stripline filters.

21. The method of claim 20, the stripline filters of the second stripline filter subassembly have a length that is longer than the length of the stripline filters in the stripline filter subassembly to facilitate interconnections between the active subassembly and the stripline filters.

22. The method of claim 20, the bonding the second stripline filter subassembly to a bottom surface of the stripline filter subassembly comprising using a prepeg material formed of a micro-porous polytetrafluorethylene structure impregnated with a thermosetting adhesive as a bonding material layer.

23. The method of claim 17, further comprising solder reflowing the switched filterbank to a top surface of a printed wiring board.

24. The method of claim 17, further comprising back drilling the contacts formed through the top surface of the active subassembly to the plurality of stripline filters to provide fifty ohm impedance matching.

* * * * *